United States Patent [19]

Ceniza

[11] Patent Number: 4,625,619

[45] Date of Patent: Dec. 2, 1986

[54] DEVICE FOR SEPARATION AND LAUNCH OF A BODY WITH LINEAR AND ROTATIONAL VELOCITY

[75] Inventor: Rogelio R. Ceniza, Milpitas, Calif.

[73] Assignee: The United States of America as represented by the Secretary of the Navy, Washington, D.C.

[21] Appl. No.: 627,330

[22] Filed: Jul. 2, 1984

[51] Int. Cl.[4] ..... F41F 5/02

[52] U.S. Cl. ..... 89/1.57; 244/63; 244/158 R; 124/16; 124/61; 124/42; 89/1.14

[58] Field of Search ..... 244/158 R, 63, 161, 244/3.23; 124/21, 29, 17, 27, 16, 26, 41 R, 42, 81, 61; 446/38, 39, 46; 89/1.816–1.819, 1.8, 1.808, 1.1, 1.14, 1.57; 102/357

[56] References Cited

U.S. PATENT DOCUMENTS

| | | | |
|---|---|---|---|
| 3,500,714 | 3/1970 | Cullinane | 124/42 |
| 3,635,204 | 1/1972 | Plumb, Jr. | 124/16 |
| 3,983,783 | 10/1976 | Maxey | 89/1.57 |
| 4,067,308 | 1/1978 | Anderson et al. | 244/158 R |
| 4,290,344 | 9/1981 | Adams | 92/31 |
| 4,300,737 | 11/1981 | Byrne et al. | 244/158 |

FOREIGN PATENT DOCUMENTS

| | | | |
|---|---|---|---|
| 008330 | 7/1978 | Japan | 244/158 R |

*Primary Examiner*—Galen L. Barefoot

*Attorney, Agent, or Firm*—R. F. Beers; C. D. B. Curry; G. L. Craig

[57] ABSTRACT

A launching structure comprising a ram driven by a piston in a cylinder. A pyrotechnic charge initiates a gas expansion underneath the piston and the expanding gases drive the ram. The ram has a helical groove engaged by a cam pin in the cylinder wall to impart a rotary motion to the ram as it is displaced linearly in the cylinder. A mass is engaged by the ram and is ejected from the cylinder with both a linear and rotational velocity.

5 Claims, 7 Drawing Figures

DEVICE FOR SEPARATION AND LAUNCH OF A BODY WITH LINEAR AND ROTATIONAL VELOCITY

BACKGROUND OF INVENTION

1. Field of Invention

This invention relates to an apparatus for launching an object such that the object has linear and rotational velocity imparted to it. More specifically, the invention relates to a cylindrical collet-release launch mechanism in which a piston driven by expanding gases launches an object with linear and rotational motion.

2. Description of Prior Art

There are numerous occasions, especially in aerospace applications, in which devices providing simple, reliable mechanical separation of two or more objects are required. Such devices are subject to very strict design requirements such as very long storage life, precise actuation characteristics, and survival under high stress loading and at extreme high and low temperatures.

The present invention provides a novel method for separation of a object and ejection with gradually increasing acceleration such that the object is given a precise velocity and a specified rotation rate. The invention is simple, quite strong, light weight, self-contained and meets the most stringent design requirements of any conventional aerospace application.

SUMMARY OF INVENTION

Briefly described is an apparatus for securely holding two objects together until release is desired and then providing reliable separation and ejection. The apparatus has a ram driven by a piston in a cylinder. A pyrotechnic charge initiates a gas expansion underneath the piston and the expanding gases drive the ram. The ram has a helical groove along its longitudinal axis which is engaged by a cam pin in the cylinder wall to impart a rotary motion to the ram as it is displaced linearly in the cylinder. A mass is engaged by the ram and is ejected from the cylinder with both a linear and rotational velocity.

A primary object of invention is to provide an apparatus for separating and ejecting one object from another at a precise velocity and with a specific rotation rate.

DESCRIPTION OF THE PREFERRED EMBODIMENT

Figure 1A:
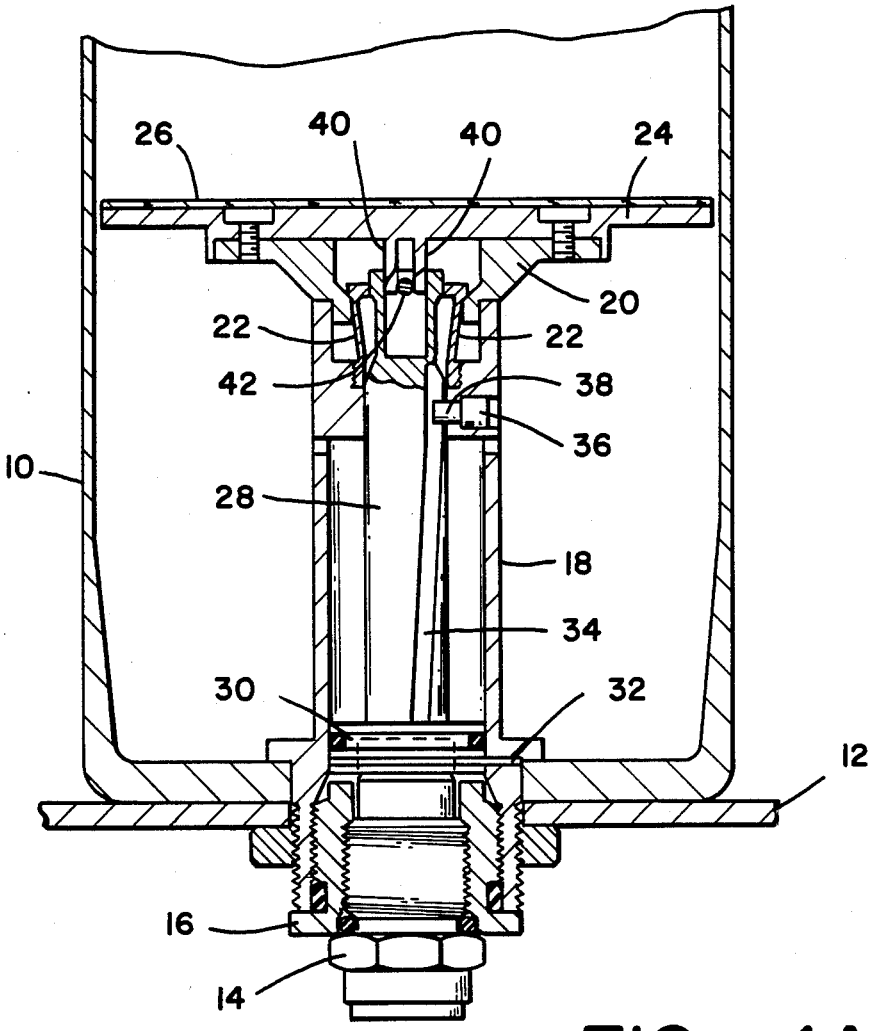
FIG. 1A is a cross-sectional view of the invention.
Figure 1B:
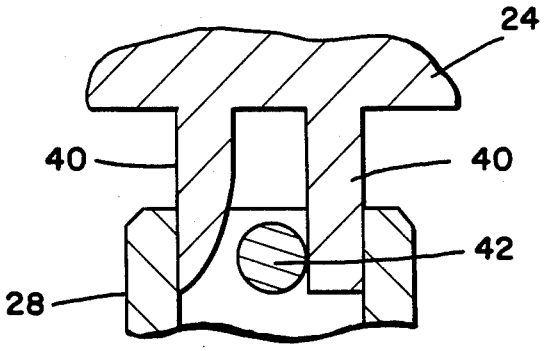
FIG. 1B is an enlarged view of the tip of the ram that engages the object to be launched.
Figure 2A:
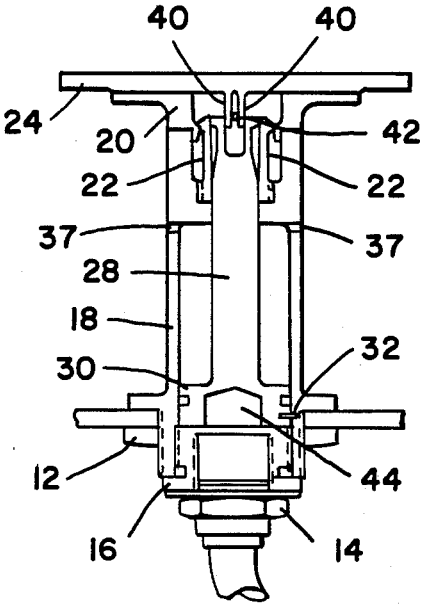
FIGS. 2A–2E are schematic sectional views of the invention in operational sequence.
Figure 2B:
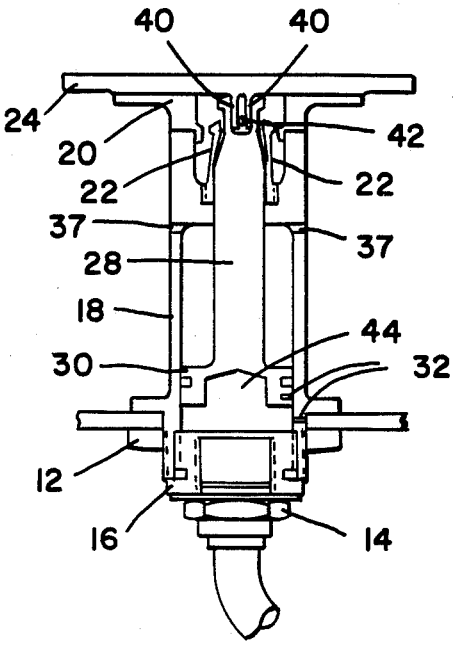
Figure 2C:
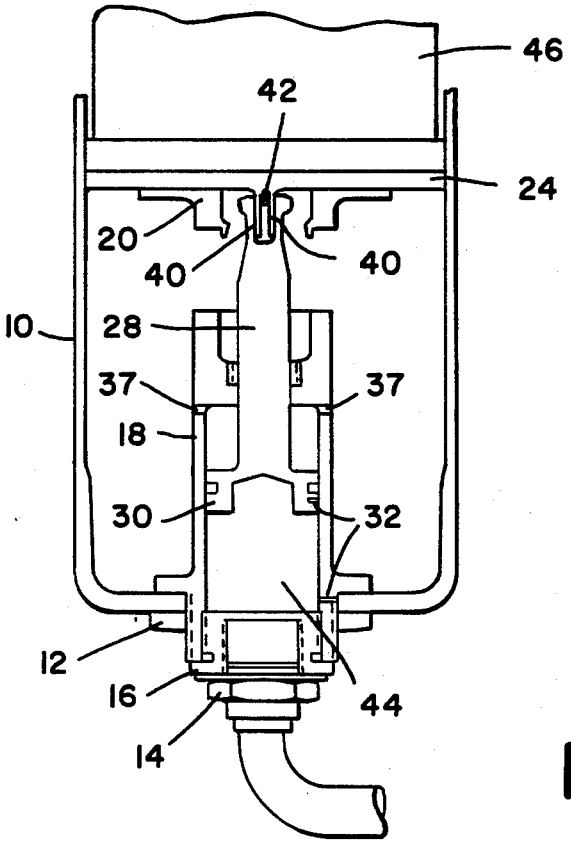
Figure 2E:
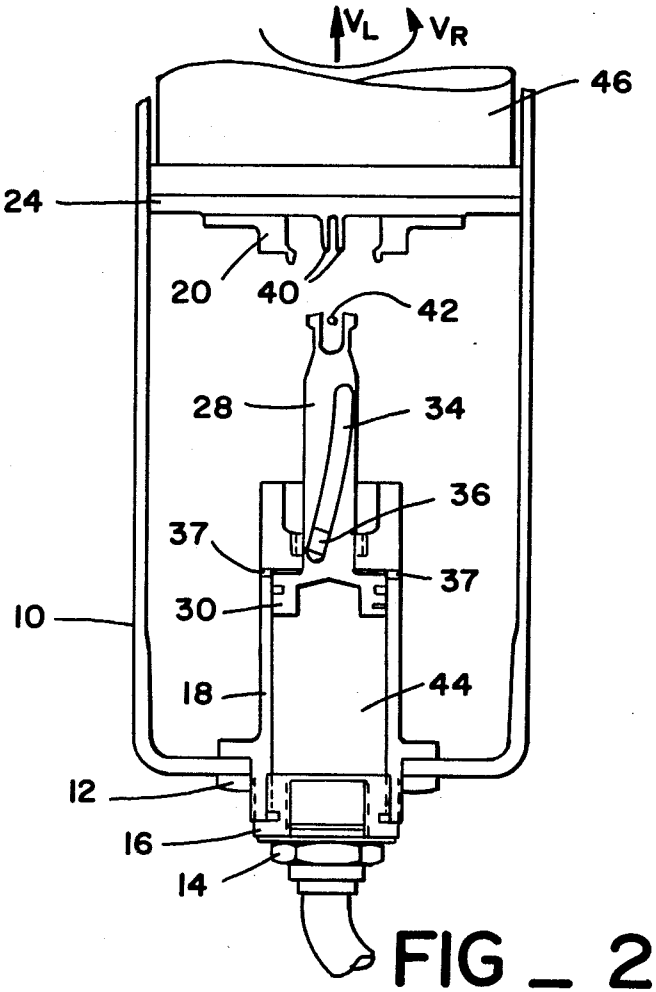
Figure 2D:
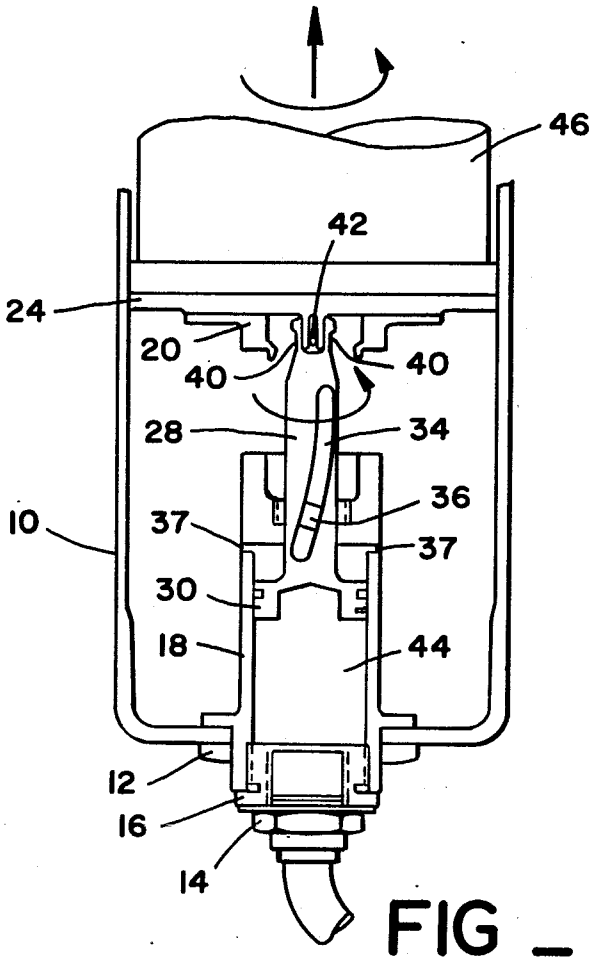

A cross-section view of the preferred embodiment of the present invention is shown in FIG. 1A. A launch tube 10 encloses the release/ejection mechanism that is the subject of the present invention and the object (not shown) to be released. The tube 10 is attached to a base plate 12 and a hole is bored through the bottom of the tube 10 along the longitudinal axis and through the base plate 12 to accomodate a pyrotechnic cartridge 14 and cartridge adaptor 16. A hollow cylindrical housing 18 is coaxially aligned with and positioned inside the tube 10 and has the lower portion extend through the bore at the tube base to engage the cartridge adapter 16. A mechanical insert 20 is held in a locked position atop the housing 18 by a collet release mechanism in which the collet fingers 22 are under a tensile load in the spread or locked position. An adapter plate 24 is attached to the top of the insert 20 and a layer of shock absorbing material 26 overlays the adaptor plate 24. The object to be launched, not shown, sits upon the absorbing material 26 and substantially occupies the remaining upper portion of the tube 10. Inside the housing 18 and coaxially aligned with it is a generally cylindrical ram 28 having a substantially smaller diameter than the cylindrical housing 18 such that an expansion chamber for the gases created by actuation of the pyrotechnic cartridge is formed between the ram and the inner wall of the housing. The ram 28 is joined to a piston 30 at its base and the piston 30 is held in place by a shear pin 32 extending into the piston 30 from the base of the cylindrical housing 18. The ram has a tapered upper neck portion having a cylindrical bore coaxial with the cylindrical housing 18 and a shoulder extends from the inner wall of the cylindrical housing to encircle the ram 28 just below the taper and still permit linear and rotational motion of the ram. A helical groove 34 extends from the beginning of the taper to the base of ram 28 and is engaged by a cam pin 36 extending from the shoulder of the cylindrical housing 18. The tip of the cam pin 36 engaging the groove 34 is surrounded by a thrust pad 38 shaped like a roller bearing to minimize friction between the cam pin 36 and the groove 34. A pair of vent holes 37 in the cylindrical housing 18 are located just below the shoulder to permit venting of any gases in the expansion chamber as the piston 30 advances. The hollow upper portion of the ram 28 spreads the collet fingers 22 in the locked position engaging the insert 20. Two protrusions 40 extend down from the adapter plate 24 into the bore in the upper portion of the ram 28 to engage a torque pin 42. An enlarged view of the protrusions 40 and the torque pin 42 is shown in FIG. 1B.

Referring to FIGS. 2A–2E, the sequence of operation of the present invention is shown. The pyrotechnic cartridge 14 is actuated causing hot gases 44 to form under the piston 30 such that it shears the shear pin 32 and begins to force the ram 28 upward in the expansion chamber of the cylindrical housing 18. As the ram 28 moves upward, the collet fingers 22 collapse inward on the tapered portion of the ram unlocking the adapter plate 24 such that it is free to move upward in the launch tube. As the ram 28 moves upward in the expansion chamber, the helical groove 34 along its length is engaged by the cam pin 36 such that the ram is given a rotational motion as well. Vent holes 37 in the cylindrical housing 18 provide venting of any gases in the expansion chamber ahead of the advancing piston 30. The protrusions 40 of the adapter plate 24 are engaged by the torque pin 42 of the advancing, rotating ram 28 and this motion is imparted to the adapter plate 24 and the object 46 fastened to the plate which is to be ejected. When the piston 30 contacts the shoulder of the cylindrical housing, motion of the ram 28 is halted and the object 46 is launched with the desired motion characteristics. Thus the present invention provides a single mechanism for holding an object until release is desired and then releasing, ejecting and spinning the object with precise values of linear and rotational velocity.

What is claimed:

1. An apparatus for releasably holding and remotely launching an object with specific motion characteristics comprising:

(a) a generally cylindrical launch tube having a central bore in its base;

(b) means for generating a high pressure gas;

(c) means for forming an expansion chamber for said gas, said forming means located primarily in said tube;

(d) means for connecting said tube, said generating means and said forming means approximate said bore in said base;

(e) means for holding releasably said object to be launched, said holding means operably connecting said forming means and said object;

(f) means for receiving releasably said linear and rotational velocity transferred by said imparting means; and (g) means for imparting predetermined linear and rotational velocity to an object, said imparting means positioned for linear and rotational movement within said forming means, said imparting means including a piston forming the base of said expansion chamber in said forming means, said piston slidably movable within said forming means; a generally cylindrical ram having a diameter less than said piston and said forming means and having its base joined to said piston, said ram also having a segment of its upper portion tapering to a neck portion, said neck portion having a bore coaxial with the longitudinal axis of said ram; a helical groove in the outer surface of said ram extending from the base of said neck portion to said piston; a cam pin extending from the interior of said forming means to slidably engage said groove, the tip of said cam pin encircled by a roller bearing to minimize friction; and a torque pin extending across said bore in said neck portion of said ram for releasable engagement of said receiving means upon actuation of said generating means.

2. The holding and launching apparatus of claim 1 wherein said forming means further comprises:

(a) a generally hollow cylinder longitudinally coaxially aligned with said launch tube, said cylinder having a segment of its lower portion extending through said bore of said tube for engagement with said connecting means and having a radial shoulder on its inner wall near its upper portion; and (b) means for holding said imparting means until said launching is desired.

3. The holding and launching apparatus of claim 2 wherein said receiving means further comprises:

(a) an annular insert releasably engaged with said forming means and said holding means;

(b) an adaptor structure spanning the circumference of said launch tube and operatively connected to said insert, said adaptor structure having two protrusions extending downward into and along the longitudinal axis of said imparting means for releasable engagement of said imparting means upon actuation of said generating means.

4. The holding and launching apparatus of claim 3 wherein said holding means is a collet device having a plurality of fingers engaging said object to be launched under a tensile locked position, said collet encircling the upper portion of said imparting means.

5. The holding and launching apparatus of claim 4 wherein said generating means is a pyrotechnic cartridge.

* * * * *